US009494386B1

(12) United States Patent
French

(10) Patent No.: US 9,494,386 B1
(45) Date of Patent: Nov. 15, 2016

(54) SYSTEM FOR VISUALLY IMPAIRED PERSON TO SHOOT A GUN, AND METHOD OF ASSEMBLING AND USING SAME

(71) Applicant: Jonathan Michael French, Chassell, MI (US)

(72) Inventor: Jonathan Michael French, Chassell, MI (US)

( * ) Notice: Subject to any disclaimer, the term of this patent is extended or adjusted under 35 U.S.C. 154(b) by 0 days.

(21) Appl. No.: 14/706,440

(22) Filed: May 7, 2015

(51) Int. Cl.
*F41G 11/00* (2006.01)
*F41A 35/00* (2006.01)

(52) U.S. Cl.
CPC ..... *F41G 11/001* (2013.01); *F41A 35/00* (2013.01)

(58) Field of Classification Search
CPC ..... F41G 11/001; F41G 11/003; F41G 11/004; F41A 35/00
See application file for complete search history.

(56) References Cited

U.S. PATENT DOCUMENTS 5,408,778 A * 4/1995 Goodwin ..... F41G 1/46 42/115
6,519,083 B2 2/2003 Heinrich
6,598,331 B1 7/2003 Thibodeaux
8,656,625 B2 2/2014 Holmberg
8,726,562 B1 * 5/2014 Hoskisson ..... F41G 11/003 42/124
8,745,914 B2 * 6/2014 Schmidt ..... F41G 11/001 42/106
8,915,008 B2 12/2014 Mauricio et al.
2014/0123532 A1 5/2014 Russ
2014/0230306 A1 8/2014 Arachequesne
2015/0107147 A1 * 4/2015 Hurley ..... F41G 11/003 42/113

FOREIGN PATENT DOCUMENTS

AT 502686 A4 * 5/2007 ..... F41G 11/001

OTHER PUBLICATIONS

Leapers QD 1 Piece Offset Heavy Duty High 30mm Tube Scope Ring up to 68mm—Weaver Picatinny Base, tacticalscope.co.uk, Mar. 13, 2014.*
B.B. Pelletier, "Why doesn't my gun shoot where the scope looks?", Oct. 20, 2005, www.pyramydair.co/blog/2005/10/why-doesn't-my-gun-shoot-where-the-scope-looks/.
MBD, "A New 'Smart Rifle' Decides When to Shoot and Rarely Misses . . . What Are the Implications?", May 18, 2013, http://politicalblindspot.com/a-new-smart-rifle-decides-when-to-s.

* cited by examiner

*Primary Examiner* — Stephen M Johnson
*Assistant Examiner* — Joshua Semick
(74) *Attorney, Agent, or Firm* — Weiner & Burt, P.C; Irvine M. Weiner; Pamela S. Burt

(57) ABSTRACT

A system to facilitate a visually impaired person's ability to actively participate in target shooting and hunting. The system elevates a scope and moves it rearwardly to allow the shooter to shoulder the rifle, while a spotter behind the shooter uses the scope and guides the shooter to move the rifle until it is on target and ready to be shot.

1 Claim, 7 Drawing Sheets

SYSTEM FOR VISUALLY IMPAIRED PERSON TO SHOOT A GUN, AND METHOD OF ASSEMBLING AND USING SAME

BACKGROUND OF THE INVENTION

The present invention relates generally to a mechanical system enabling a visually impaired person to shoot/operate a gun, and a method of assembling and using said system.

More particularly, the present invention relates to a mechanical system enabling a visually impaired person to shoot/operate a gun which system elevates a telescopic sight above and to the rear of a conventional telescopic sight, and a method of assembling and using said system.

The phrase "visually impaired person" as used herein means a person who is blind or who has other vision problems.

Conventional equipment and systems do not enable non-sighted veterans and other visually impaired persons to participate in and enjoy outdoor activities such as hunting and target shooting.

It is a desideratum of the present invention to avoid the animadversions of conventional equipment and systems, and to provide a very efficient mechanical system enabling a visually impaired person to shoot/operate a gun, and a method of assembling and using said system.

SUMMARY OF THE INVENTION

The present invention provides a mechanical system enabling a visually impaired person to shoot/operate a gun, comprising: a gun; a single telescopic sighting device; mounting means mechanically and operably interconnected between the gun and the telescopic sighting device which mounting means offsets the telescopic sighting device above the gun and toward a rear end of the gun to allow a second person to use the telescopic sighting device; the mounting means includes a main elongated device, first means for releasably mounting the main elongated device to the gun, second means for releasably mounting the telescopic sighting device to the main elongated device, and adjustment means for sliding the main elongated device and the telescoping sighting device to a desired position to adjust an eye relief between an eye of the second person and a rear end of the telescoping sighting device; and whereby the system enables the second person to be positioned behind the visually impaired person to use the telescoping sighting device and to instruct the visually impaired person to move the gun to a position where the gun is on target.

The present invention also provides a method of assembling and using a mechanical system enabling a visually impaired person to shoot/operate a gun, wherein the system comprises: a gun; a single telescopic sighting device; mounting means mechanically and operably interconnected between the gun and the telescopic sighting device which mounting means offsets the telescopic sighting device above the gun and toward a rear end of the gun to allow a second person to use the telescopic sighting device; the mounting means includes a main elongated device, first means for releasably mounting the main elongated device to the gun, second means for releasably mounting the telescopic sighting device to the main elongated device, and adjustment means for sliding the main elongated device and the telescoping sighting device to a desired position to adjust an eye relief between an eye of the second person and a rear end of the telescoping sighting device; and whereby the system enables the second person to be positioned behind the visually impaired person to use the telescoping sighting device and to instruct the visually impaired person to move the gun to a position where the gun is on target, comprising the steps of: attaching the first means to the gun; pre-drilling threaded holes in the main elongated device; attaching the second means to the main elongated device using screws and the pre-drilled threaded holes; attaching the main elongated device to the first means so that a rear end of the main elongated device is approximately 5 to 6 inches in front of the butt stock plate of the gun; leveling the main elongated device to the gun using a scope leveling kit; mounting the telescoping sighting device to the second means; leveling the telescoping sighting device to the gun using a scope leveling kit; positioning the visually impaired person with the assembled gun; and positioning the second person behind the visually impaired person to use the telescoping device and to instruct the visually impaired person to move the gun to a position where the gun is on target.

It is an object of the present invention to provide a system and method as described above, which enables non-sighted veterans and other visually impaired persons to participate in and still enjoy outdoor activities such as hunting and target shooting.

Another object is to provide such a mechanical system which excludes electronic device usage to allow a visually impaired person to shoot/operate a firearm independently without the adverse effects of cold, wet weather hunting conditions on the electronics and battery life.

Another object is to provide a rather simple sighting system that allows visually impaired people to target-shoot and hunt.

Another object is provide such a system and method to help persons who greatly enjoyed hunting and the outdoors prior to their combat injuries.

Another object is to provide such a system and method all persons, especially combat wounded veterans to help aid in their recovery.

Other objects, advantages, and features of the present invention will become apparent to those persons skilled in this particular area of technology and to other persons after having been exposed to the present patent application when read in conjunction with the accompanying patent drawings.

DETAILED DESCRIPTION OF PREFERRED EMBODIMENTS OF THE INVENTION

With reference to the drawings, the present invention provides a mechanical system 10 enabling a visually impaired person 1 to shoot/operate a gun, such as a rifle 11.

Figure 1:
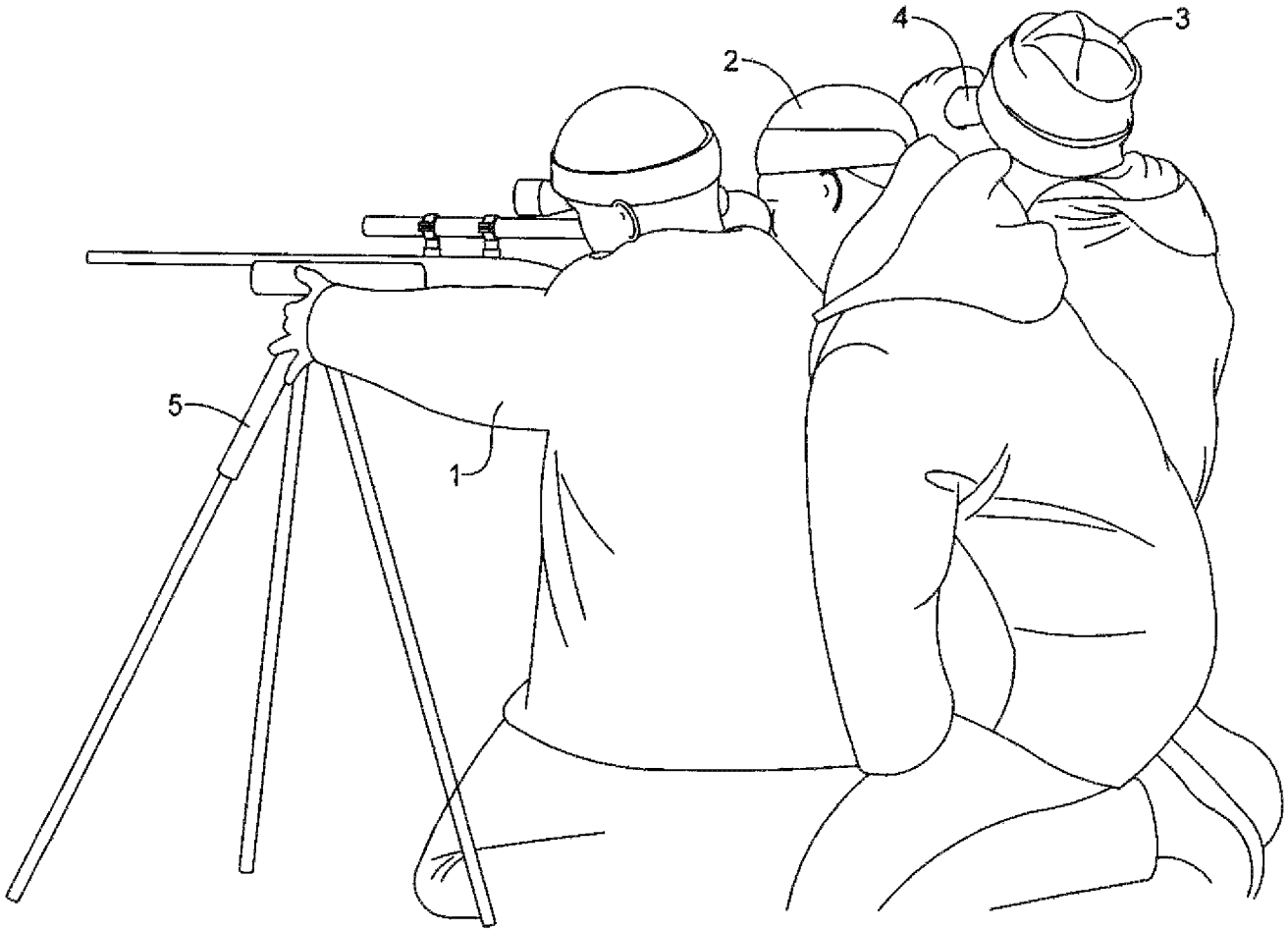
FIG. 1 is a view of the inventive system in use enabling a visually impaired person to shoot/operate a rifle.
Figure 2:
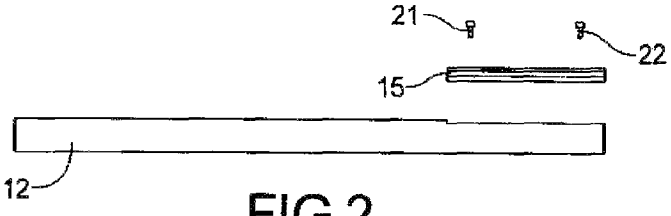
FIG. 2 is a view of the scope mount being assembled to the cylindrical member.
Figure 3:
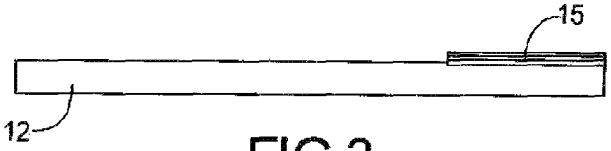
FIG. 3 is a view of the scope mount assembled to the cylindrical member.
Figure 4:
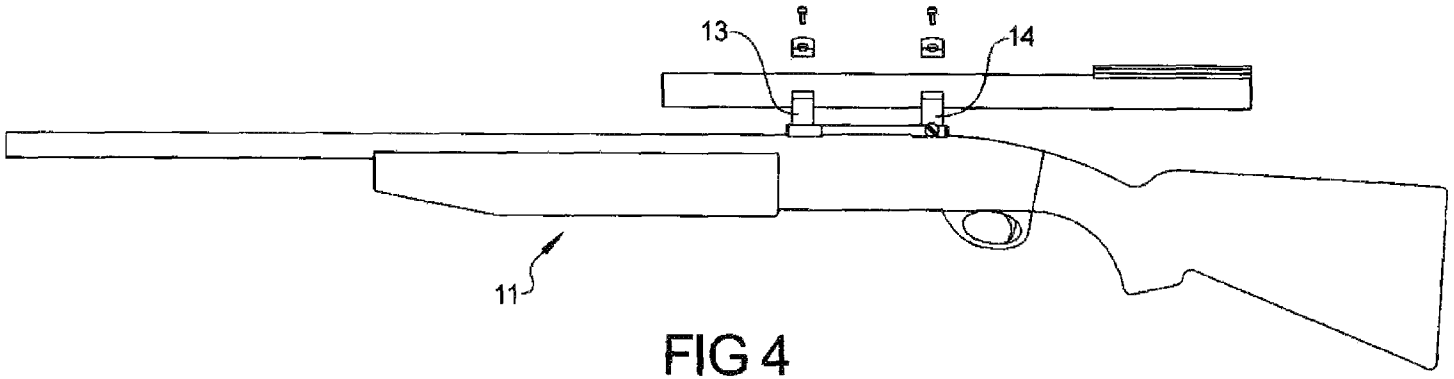
FIG. 4 is a view showing the cylindrical member being assembled to the rifle.
Figure 5:
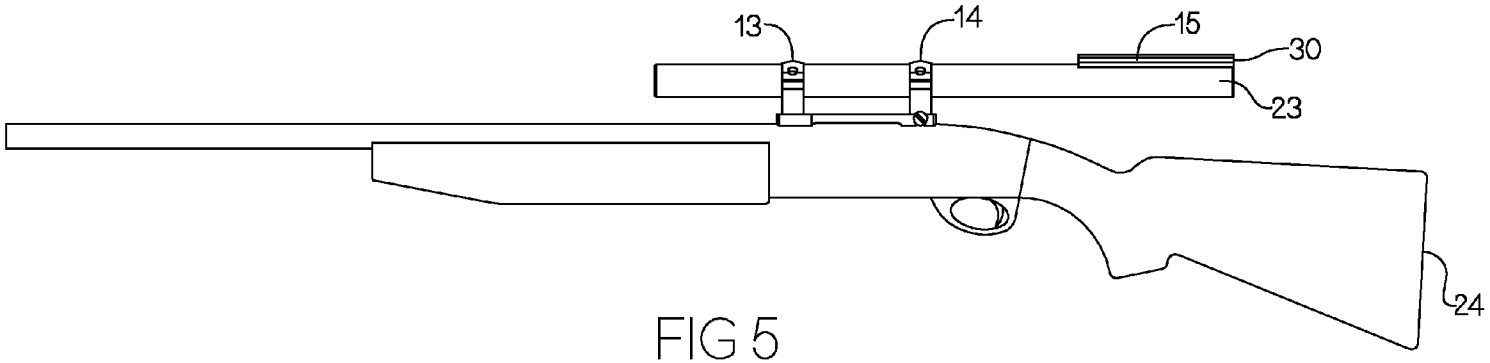
FIG. 5 is a view showing the cylindrical member assembled to the rifle.
Figure 6:
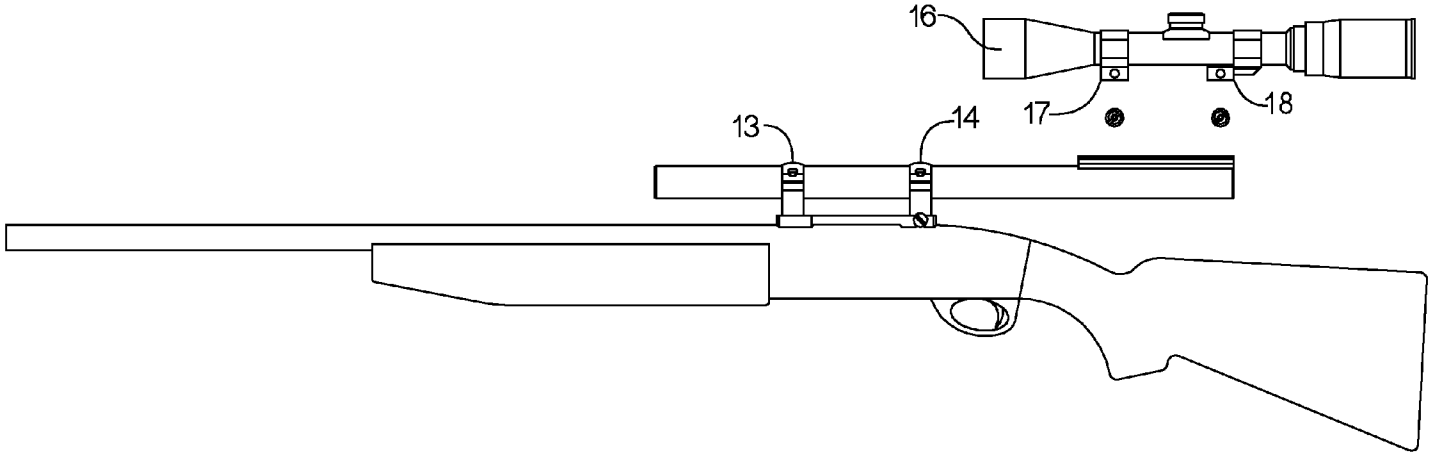
FIG. 6 shows a first step in assembling the scope to the scope mount.
Figure 7:
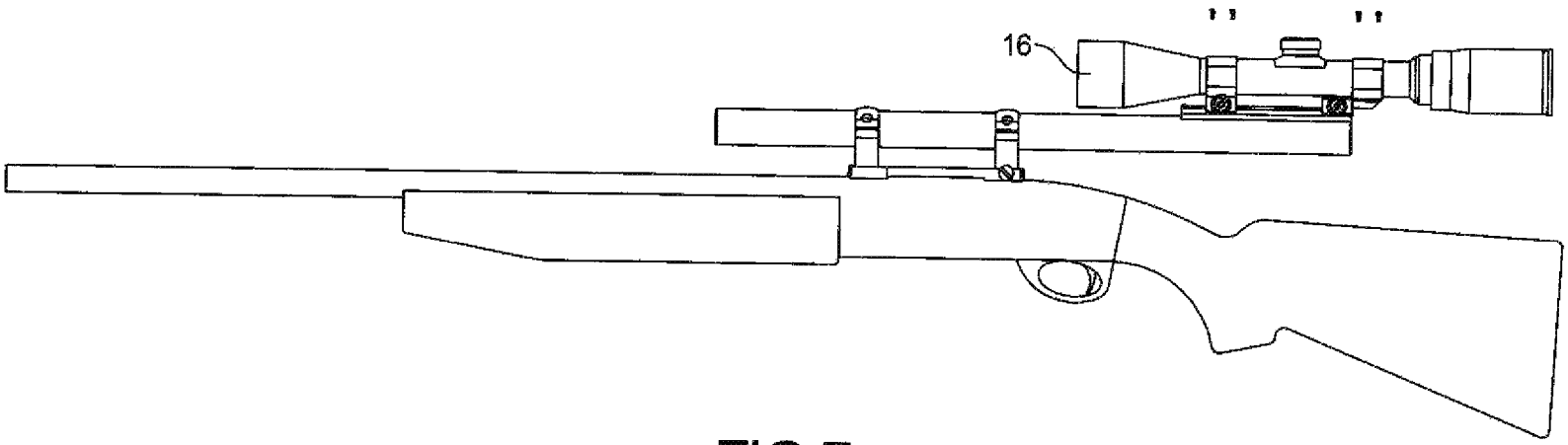
FIG. 7 shows a second step in assembling the scope to the scope mount.
Figure 8:
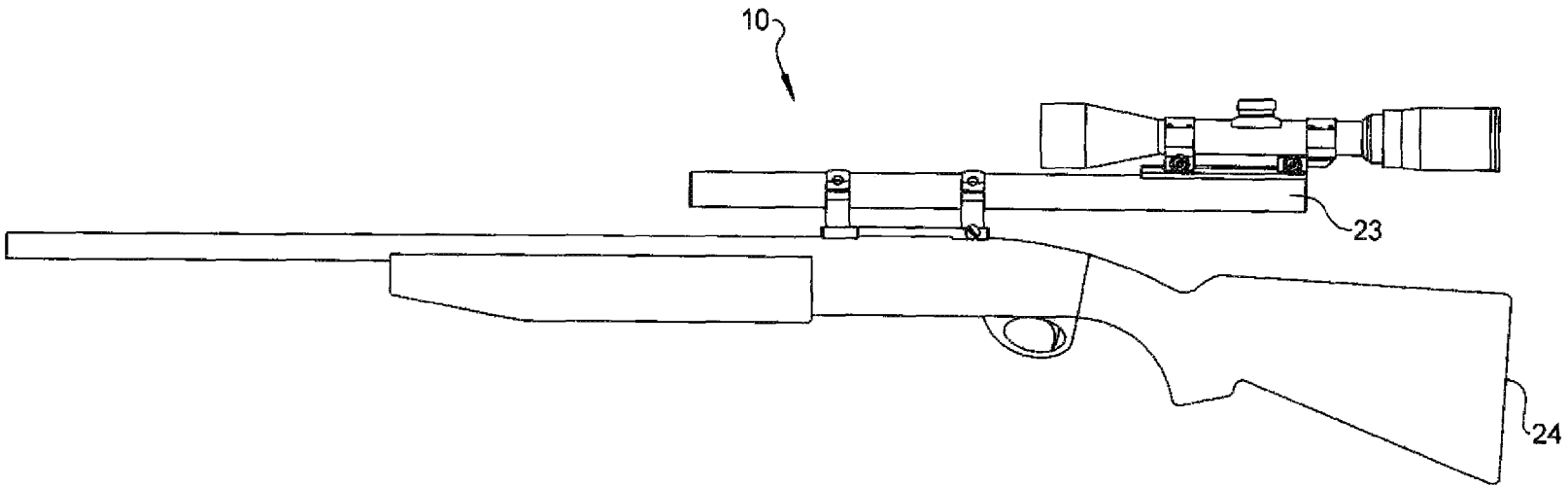
FIG. 8 shows the scope fully assembled to the scope mount.
Figure 9:
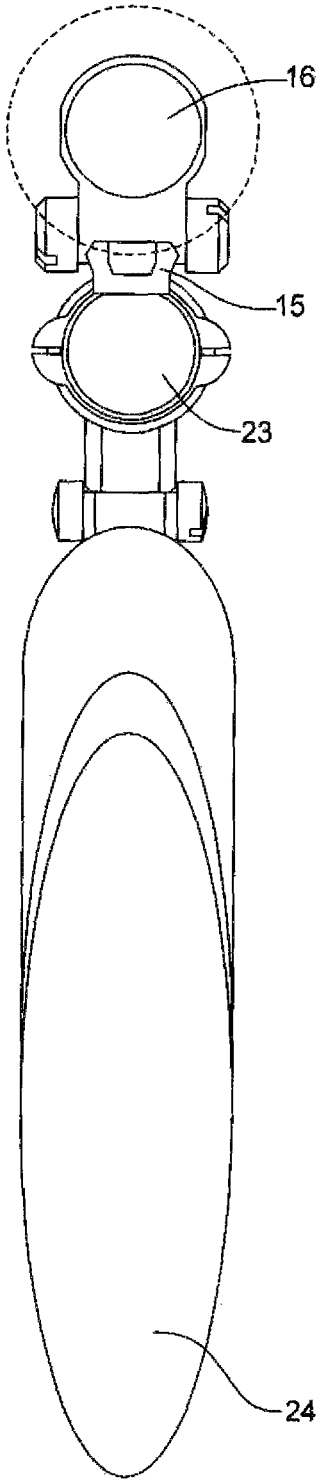
FIG. 9 is a rear elevational view of apparatus shown in FIG. 8.
Figure 10:
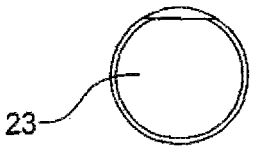
FIG. 10 is a rear elevational view showing the flat end of the cylindrical member.
Figure 11:
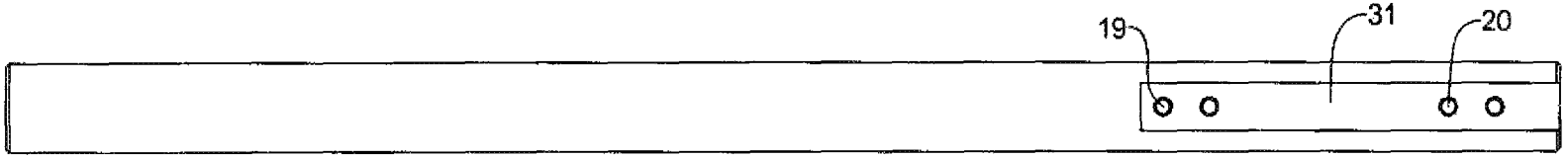
FIG. 11 is a top plan view of the cylindrical member.
Figure 12:
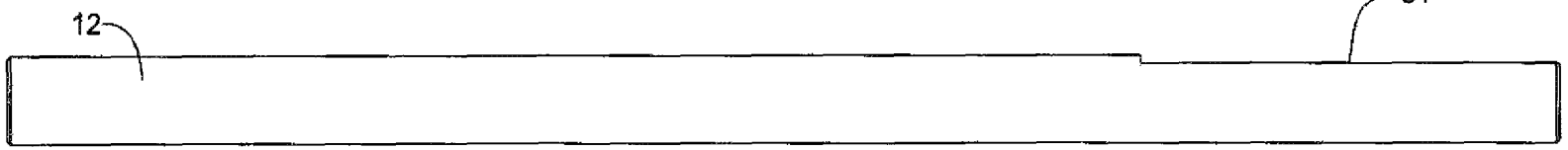
FIG. 12 is a side view of FIG. 11.

With reference to FIG. 1, there is shown a visually impaired person 1 (the "shooter"), a second person 2 (the "spotter"), and an optional third person 3 with binoculars 4 to view the target.

The inventive system 10 is used in conjunction with shooting sticks or a bipod or tripod 5.

The shooter 1 positions himself/herself on his/her knees with the spotter 2 kneeling or crouching directly behind the shooter 1.

The shooter 1 shoots off his/her knees and uses either shooting sticks or a bi-pod or a tripod 5.

The spotter 2 kneels or crouches behind and instructs the shooter 1 until he/she is on target.

The system 10 allows the spotter 2 to line up the sights.

Using the cylinder 12, the spotter 2 can adjust the eye relief between the spotter's eye and the back of the scope 16 by simply loosening the cylinder 12 and sliding the scope 16 to the desired position.

Good communication, good shooting fundamentals and practice are all needed for both precision and accuracy.

Precision and accuracy are dependent on good shooting fundamentals, practice and good communication between the shooter 1 and the spotter 2.

Depending on the shooting situation, either verbal or physical communication may be used.

Verbal commands should be brief and clear.

Physical commands may include tapping on the shooter's back.

Tapping on the shooter's upper back/lower neck may mean to aim higher; left side of back-aim left; lower back-aim lower; right side of back-aim right.

Whatever method is used, it is a good safety measure to place the palm of the spotter's hand flat on the shooter's back when he/she is on target and it is safe to shoot.

If the target moves suddenly or the situation becomes unsafe, the spotter 2 lifts his/her hand off the shooter's back signaling it is unsafe to shoot.

With reference to FIGS. 2, 3, 10, 11 and 12, there is shown a solid metal elongated cylindrical member 12 which is the same size in diameter as the set of scope rings 13 and 14 attached to the rifle 11.

The rear 23 of cylinder 12 is cut flat towards the back to be coplanar with the rear end 30 of scope mount 15 and to show where the scope is mounted.

As best seen in FIGS. 2, 9, 10, 11 and 12, a portion 31 of the cylinder 12 is formed flat and pre-drilled.

To assemble the system 10, layout the rifle 11 with scope rings 13 and 14 and scope mounts already attached, the elongated cylindrical member 12, the scope mount 15, the scope 16 with a second set of scope rings 17 and 18.

Make sure that the cylindrical member 12 is the same size in diameter as the set of scope rings 13 and 14 attached to the rifle 11.

Take the scope mount 15 and attach it to the pre-drilled/threaded holes 19 and 20 of the cylindrical member 12 with screws 21 and 22 and thread locking compound. Torque down the screws 21 and 22 to 20-25 inch-pounds of pressure.

Attach the cylindrical member 12 to the rifle's existing lower rings 13 and 14 and scope mount system.

The rear 23 of the cylindrical member 12 should be approximately 5"-6" in front of the butt stock plate 24 of the rifle 11.

After replacing the top of the rifle's scope rings 13 and 14, level the cylindrical member 12 to the rifle 11 with a scope leveling kit.

Tighten the screws equally to the manufacturer's specifications. Do not use thread compound on these screws at this stage.

Mount the scope 16 with the upper scope rings onto the scope mount 15.

Apply thread compound to bolt threads.

Ensure the cross-through bolts of the rings are pushed forwardly in the address slots and tighten to 20-25 inch-pounds of pressure.

Level the scope 16 to the rifle using a scope leveling kit.

Apply thread compound to the upper scope ring screws, and tighten to the manufacturer's specifications.

It is recommended that the rifle 11 installed with the inventive system 10 be sighted in at 25 yards prior to moving back to a 100-yard zero.

Zero the rifle 11 in accordance with the scope manufacturer's specifications and the shooter's needs.

The system 10 thus includes a gun, such as a rifle 11, a single telescopic sighting device 16, and mounting means mechanically and operably interconnected between the gun 11 and the telescopic sighting device 16 which mounting means offsets the telescopic sighting device 16 above the gun 11 and toward a rear end of the gun 11 to allow the spotter 2 to use the telescopic sighting device 16.

The mounting means includes the main elongated device, such as an aluminum cylindrical member 12, first means for releasably mounting the main elongated device 12 to the gun 11, second means for releasably mounting the telescopic sighting device 16 to the main elongated device 12, and adjustment means for sliding the main elongated device 12 and the telescoping sighting device 16 to a desired position to adjust an eye relief between an eye of the spotter 2 and a rear end of the telescoping sighting device 16.

The system 10 enables the spotter 2 to be positioned behind the visually impaired person 1 to use the telescoping sighting device 16 and to instruct the visually impaired person 1 to move the gun 11 to a position where the gun 11 is on target.

While the system and method herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

The description of the invention set forth hereinabove, together with the accompanying drawings, should not be construed as limiting the invention to the examples shown and described, because those skilled in the art to which this invention appertains may be able to devise other forms thereof within the ambit of the appended claims.

The invention claimed is:

1. A mechanical system enabling a non-sighted veteran or other visually-impaired person/shooter (1) to shoot/operate a rifle (11) when instructed and guided by a second person or spotter (2) positioned directly behind the non-sighted veteran or other visually-impaired person/shooter (1) to use a single telescoping sighting device (16) and to instruct and guide the non-sighted veteran or other visually-impaired person/shooter (1) to move the rifle (11) to a position where the rifle (11) is on target, comprising, in combination:

a rifle (11) including a muzzle and a butt stock plate (24);

shooting sticks or a bipod or a tripod (5);

a single telescopic sighting device (16);

mounting means mechanically and operably interconnected between said rifle (11) and said single telescopic sighting device (16), which mounting means offsets said single telescopic sighting device (16) above said rifle (11) and toward said butt stock plate (24) of said rifle (11) to allow the second person or spotter (2) to use said single telescopic sighting device (16);

said mounting means includes a main elongated device (12), first means (13 and 14) for releasably mounting said main elongated device (12) to said rifle (11), second means (15) for releasably mounting said single telescopic sighting device (16) to said main elongated device (12), and adjustment means for sliding said main elongated device (12) and said single telescoping sighting device (16) to a desired position to adjust an eye relief between an eye of the second person or spotter (2) and a rear end of said single telescoping sighting device (16);

said first means comprises a first set of scope rings (13 and 14) attached to said rifle (11);

said second means comprises a scope mount (15);

said main elongated device comprises a solid metal elongated cylindrical member (12) which has the same diameter size as that of said first set of scope rings (13 and 14) attached to said rifle (11);

a portion (31) of said main solid metal elongated cylindrical member (12) is formed flat and pre-drilled with threaded holes (19 and 20) therewithin;

said scope mount (15) is attached to said main solid metal elongated cylindrical member (12) using screws (21 and 22) and said pre-drilled threaded holes (19 and 20);

a rear aperture of said single telescopic sighting device (16) is aligned forward and above said butt stock plate (24) of said rifle (11);

a rear end (23) of said main solid metal elongated cylindrical member (12) is cut flat to be coplanar with a rear end (30) of said scope mount (15);

said main solid metal elongated cylindrical member (12) is attached to said rifle (11) with said first set of scope rings (13 and 14) so that said rear end (23) of said solid metal elongated cylindrical member (12) is approximately five to six inches in front of said butt stock plate (24) of said rifle (11);

said main solid metal elongated cylindrical member (12) is levelled to said rifle (11) using a scope leveling kit;

said single telescoping sighting device (16) is levelled to said rifle (11) using a scope leveling kit;

said adjustment means comprises a second set of scope rings (17 and 18) and mounting screws therefor whereby the second person or spotter (2) loosens said mounting screws for said second set of scope rings (17 and 18) and slides said main solid metal elongated cylindrical member (12) toward said muzzle of or toward said butt stock plate (24) of said rifle (11) to allow the second person or spotter (2) to obtain a correct eye-relief distance between the eye of the second person or spotter and said rear aperture of said single telescopic sighting device (16) to obtain a full field of view in said single telescopic sighting device (16);

the rifle as hereinabove assembled is positioned on said shooting sticks or said bipod or said tripod (5);

the non-sighted veteran or other visually-impaired person/shooter (1) positions himself/herself on his/her knees with the second person or spotter (2) kneeling or crouching directly behind the non-sighted veteran or other visually-impaired person/shooter (1);

the non-sighted veteran or other visually-impaired person/shooter (1) shoots off his/her knees and uses said rifle as hereinabove assembled supported at least in part by said shooting sticks or said bipod or said tripod (5); and the second person or spotter (2) is positioned behind the non-sighted veteran or other visually-impaired person/shooter (1) to use said single telescoping device (16) and to instruct and guide the non-sighted veteran or other visually-impaired person/shooter (1) to move the assembled rifle to a position where the assembled rifle is on target.

* * * * *